US009402126B2

(12) United States Patent
Yeh

(10) Patent No.: US 9,402,126 B2
(45) Date of Patent: Jul. 26, 2016

(54) EARPHONE WITH PASSIVE RADIATOR

(71) Applicant: MERRY ELECTRONICS (SHENZHEN) CO., LTD., Shenzhen (CN)

(72) Inventor: Ruei-Ting Yeh, Taichung (TW)

(73) Assignee: MERRY ELECTRONICS (SHENZHEN) CO., LTD. (CN)

( * ) Notice: Subject to any disclaimer, the term of this patent is extended or adjusted under 35 U.S.C. 154(b) by 43 days.

(21) Appl. No.: 14/255,527

(22) Filed: Apr. 17, 2014

(65) Prior Publication Data

US 2015/0304760 A1 Oct. 22, 2015

(51) Int. Cl.

*H04R 1/20* (2006.01)
*H04R 1/10* (2006.01)
*H04R 1/28* (2006.01)

(52) U.S. Cl.

CPC ..... *H04R 1/1058* (2013.01); *H04R 1/1091* (2013.01); *H04R 1/283* (2013.01); *H04R 1/2834* (2013.01); *H04R 1/2849* (2013.01); *H04R 2231/003* (2013.01)

(58) Field of Classification Search

CPC ..... H04R 1/28; H04R 1/2815; H04R 1/2819; H04R 1/2823; H04R 1/2834; H04R 1/2846; H04R 7/04; H04R 7/26; H04R 2307/025; H04R 2307/027; H04R 2499/15; H04R 1/1058; H04R 1/283; H04R 1/2842; H04R 2231/001; H04R 2231/003

USPC ..... 381/332, 335, 337, 345, 346, 348, 349, 381/351, 370, 371, 386; 181/144, 145, 148, 181/155, 156, 163, 199

See application file for complete search history.

(56) References Cited

U.S. PATENT DOCUMENTS 3,780,824 A * 12/1973 Prince ..... 181/144
4,301,332 A * 11/1981 Dusanek ..... 381/349
2010/0111343 A1* 5/2010 Hsu ..... 381/335

* cited by examiner

*Primary Examiner* — Huyen D Le
(74) *Attorney, Agent, or Firm* — Bacon & Thomas, PLLC

(57) ABSTRACT

An earphone includes a housing having a sound-emitting hole, a speaker mounted in the housing, and a passive radiator mounted in between the sound hole and the speaker driver and including a vibrating diaphragm main body and a weight embedded in the vibrating diaphragm main body or bonded to the top or bottom surface of the vibrating diaphragm main body. The mounting arrangement of the passive radiator optimizes the sound performance of the earphone. The weight of the passive radiator is firmly connected with the vibrating diaphragm main body so that severe vibration of the vibrating diaphragm main body does not cause disconnection of the weight.

7 Claims, 4 Drawing Sheets

EARPHONE WITH PASSIVE RADIATOR

BACKGROUND OF THE INVENTION

1. Field of the Invention

The present invention relates to earphone technology, and more particularly, to an earphone having a passive radiator therein.

2. Description of the Related Art

Passive vibration diaphragm, also called as passive radiator, is normally mounted with a speaker in a cabinet to share the back cavity so that when the speaker converts electrical energy to sound waves, the air in the back cavity is compressed and transferred to the passive radiator, thereby indirectly driving the passive radiator to emit sound waves. Subject to the assistance of a passive radiator in a miniature speaker, the resonance effect of the back cavity is enhanced, and the overall performance of the sound field is optimized.

However, the applications of conventional passive radiators are mostly limited to large speakers without being seen in earphones. The back cavity of an earphone is relatively smaller, so its resonance and bass drop sound effects are limited. Therefore, downsizing a passive radiator for installation in an earphone can effectively optimize the overall audio performance of the earphone and enhance its competitiveness on the market.

SUMMARY OF THE INVENTION

The present invention has been accomplished under the circumstances in view. It is the main object of the present invention to provide an earphone, which enhances the resonance effect of the back cavity and optimizing audio performance.

It is another object of the present invention to provide an earphone, which has a passive radiator built therein, enabling a weight in the passive radiator to be firmly connected with the vibrating diaphragm.

To achieve these and other objects of the present invention, an earphone of the invention comprises a housing, a speaker, and a passive radiator. The housing comprises at least one sound hole. The speaker is mounted in the housing. The passive radiator comprises a vibrating diaphragm main body and a weight. The passive radiator is disposed between the sound hole and the speaker. The weight is embedded in the vibrating diaphragm main body.

In an alternate form of the present invention, the earphone comprises a housing, a speaker, and a passive radiator, wherein the housing comprises at least one sound hole; the speaker is mounted in the housing; the passive radiator is disposed between the at least one sound hole and the speaker, comprising a vibrating diaphragm main body and a weight bonded to the top or bottom surface of the vibrating diaphragm main body.

Subject to the mounting arrangement of the passive radiator, the sound performance of the earphone is optimized, and the weight of the passive radiator is firmly connected with the vibrating diaphragm main body. Even if the vibrating diaphragm main body vibrates heavily, the weight will not fall.

Preferably, the vibrating diaphragm main body is made by molding. The vibrating diaphragm main body is configured to provide at least one through hole through which the material for making the weight, for example, polyurethane (PU) can be injected through the at least one through hole into the inside of the vibrating diaphragm main body.

Further, the vibrating diaphragm main body composed of two composite layers and the weight can be separately made and then a press-forming technique is employed to have the weight be firmly embedded in between the two composite layers of the vibrating diaphragm main body.

Other advantages and features of the present invention will be fully understood by reference to the following specification in conjunction with the accompanying drawings, in which like reference signs denote like components of structure.

DETAILED DESCRIPTION OF THE INVENTION

Figure 1:
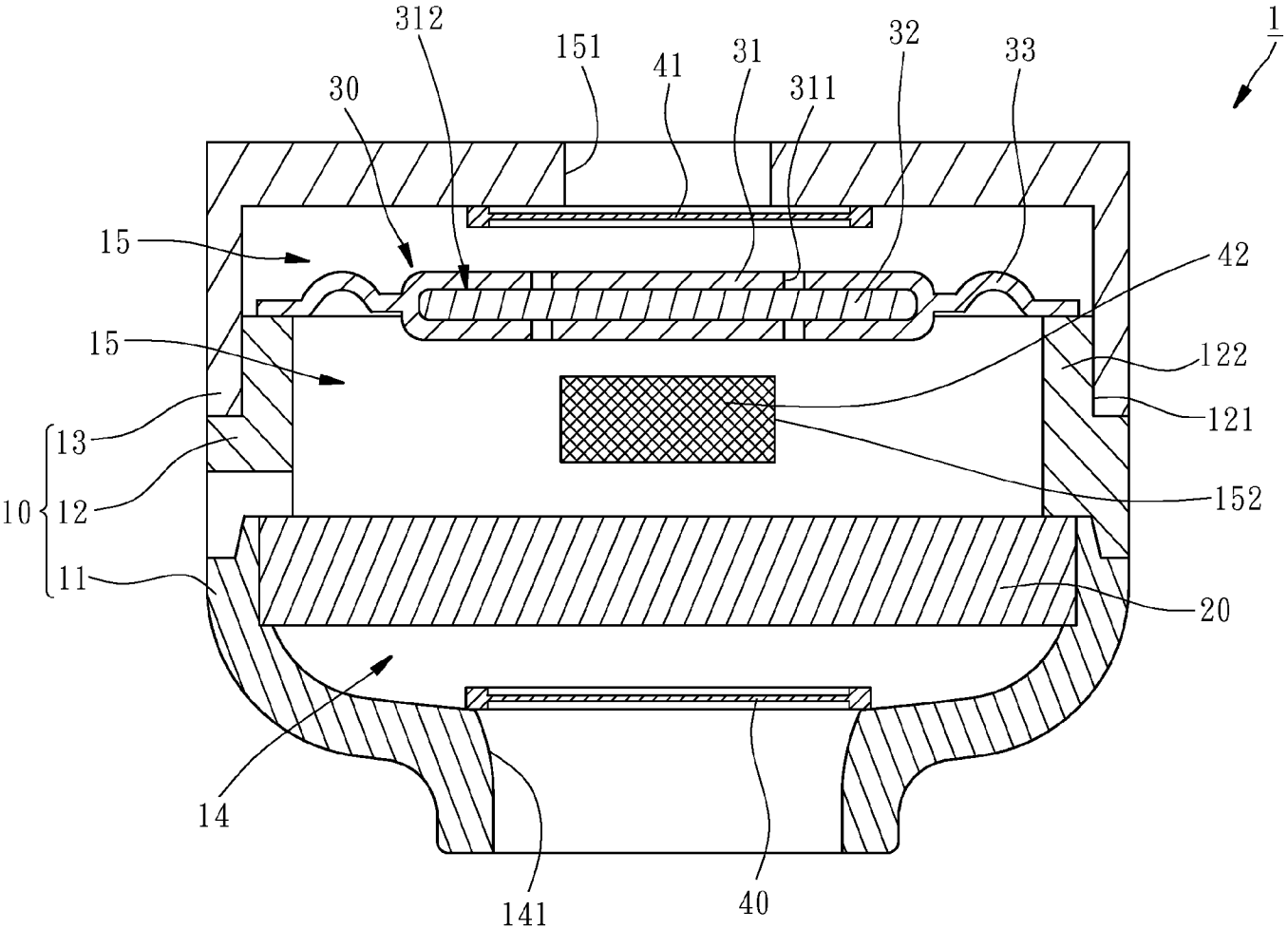
FIG. 1 is a sectional view of an earphone in accordance with a first embodiment of the present invention.
Figure 2:
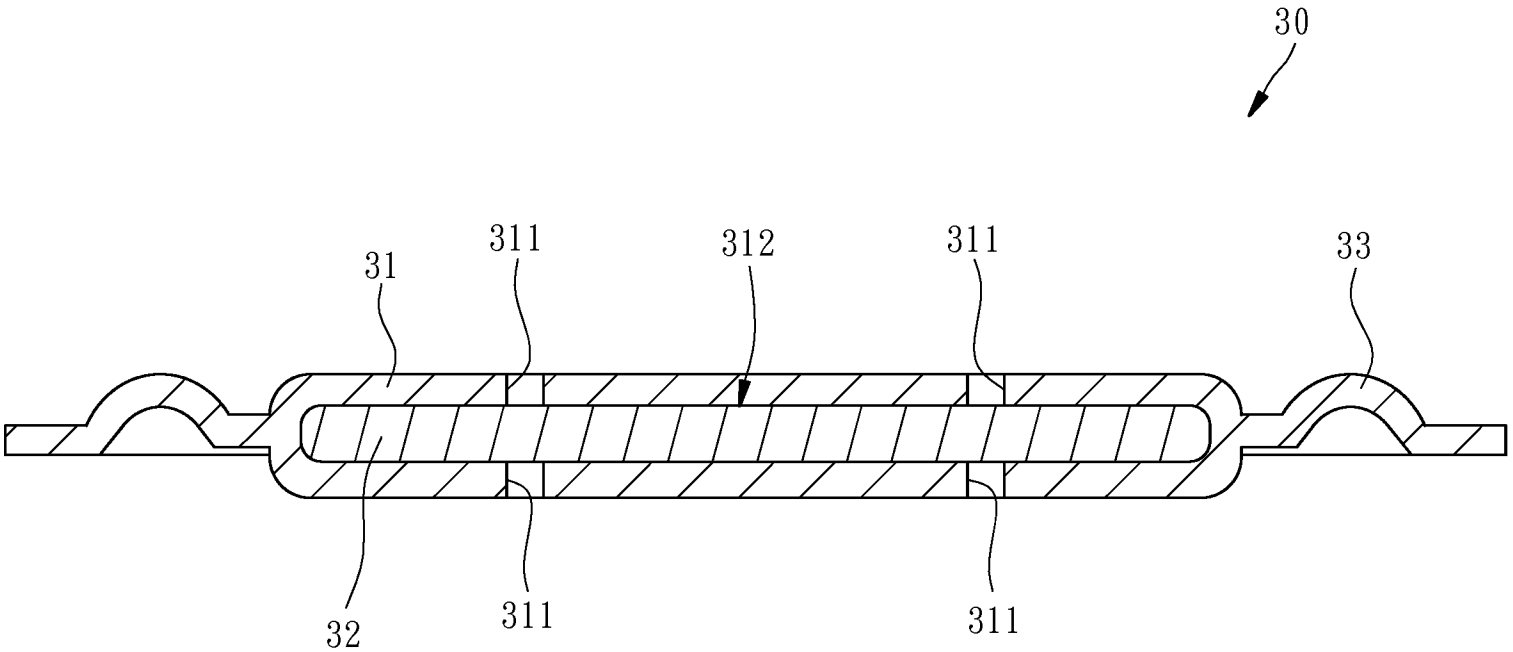
FIG. 2 is a sectional view of the passive radiator of the earphone in accordance with the first embodiment of the present invention.

For easily understanding the structural details and features of the present invention, an earphone 1 in accordance with a first embodiment is provided and illustrated in FIGS. 1 and 2. As illustrated, the earphone 1 comprises a housing 10, a speaker 20, and a passive radiator 30. The structural details of these component parts and their relative relationship are explained hereinafter.

Referring to FIG. 1 again, the housing 10 is a hollow member comprised of a first outer shell 11, a second outer shell 12 and an outer cover 13. The second outer shell 12 is press-fitted onto the first outer shell 11, comprising an annular groove 121 and an inner flange 122 located at one side thereof remote from the first outer shell 11. The outer cover 13 is fastened to the annular groove 121 of the second outer shell 12.

The speaker 20 is fixedly mounted in the first outer shell 11 of the housing 10 to divide the internal space of the housing 10 into a first cavity 14 and a second cavity 15. A first sound hole 141 is formed in the first outer shell 11 in communication with the first cavity 14 for the passing of the sound waves created by the speaker 20 to the user's ear. A second sound hole 151 is formed in the outer cover 13 in communication with the second cavity 15. Further, an auxiliary sound hole 152 is formed in the second outer shell 12.

It is to be noted that, in this first embodiment, a first ventilation mesh 40, a second ventilation mesh 41 and a third ventilation mesh 42 are respectively mounted in the sound hole 141, the second sound hole 151 and the auxiliary sound hole 152 to adjust sound effects and to provide a waterproof effect; however, these ventilation meshes (40, 41 & 42) are not requisite components.

Referring to FIG. 2 again, the passive radiator 30 comprises a vibrating diaphragm main body 31, a weight 32 and a surround 33, wherein the surround 33 surrounds and is connected with the peripheral edge of the vibrating diaphragm main body 31; the passive radiator 30 is fastened to the inner flange 122 of the second outer shell 12 through the surround 33 to shield the second sound hole 151. The vibrating diaphragm main body 31 and the surround 33 are integrally molded in one piece. Further, the vibrating diaphragm main body 31 comprises an accommodation chamber 312, and two pairs of through holes 311 bilaterally located in opposing top and bottom sides thereof in communication between the accommodation chamber 312 and the space outside the vibrating diaphragm main body 31 for the injection of a high density material to make the desired weight 32 and to have the weight 32 thus made be steadily embedded in the accommodation chamber 312 inside the vibrating diaphragm main body 31.

It is to be noted that the material for the vibrating diaphragm main body 31 can be mylar diaphragm; the material for the weight 32 can be selected from the group of polyurethanes (PUs) and silicon compounds.

When the speaker 20 generates sound, it will compress the air in the second cavity 15 and force the air toward the passive radiator 30, thereby indirectly driving the vibrating diaphragm main body 31 of the passive radiator 30 to vibrate and to produce sound. Because the weight 32 is steadily embedded in the vibrating diaphragm main body 31, heavy vibration of the vibrating diaphragm main body 31 does not cause the weight 32 to fall out of the vibrating diaphragm main body 31 and to further affect the normal operation of the passive radiator 30. Subject to the assistance of the passive radiator 30 and the tuning effect of the ventilation mesh 42 in the auxiliary sound hole 152, the resonance effect of the second cavity 15 of the earphone 1 is greatly enhanced, and the earphone 1 is capable of getting great audio valance and strengthening the feeling of spatial sense, thereby effectively optimizing the overall sound performance.

It is to be noted that the passive radiator 30 of the present invention has a simple structure, facilitating mass production. Further, the passive radiator 30 is not limited to earphone applications, it can also be used for headphone applications.

Alternatively, the passive radiator 30 can be fixedly mounted in the inner wall of the outer cover 13 and covered over the second sound hole 151, achieving the same effect of strengthening the feeling of spatial sense. Further, the amount of the through holes 311 is not limited to 4. Actually, the number of the through holes 311 can be increased, or reduced to 1, to meet actual requirements.

Figure 3:
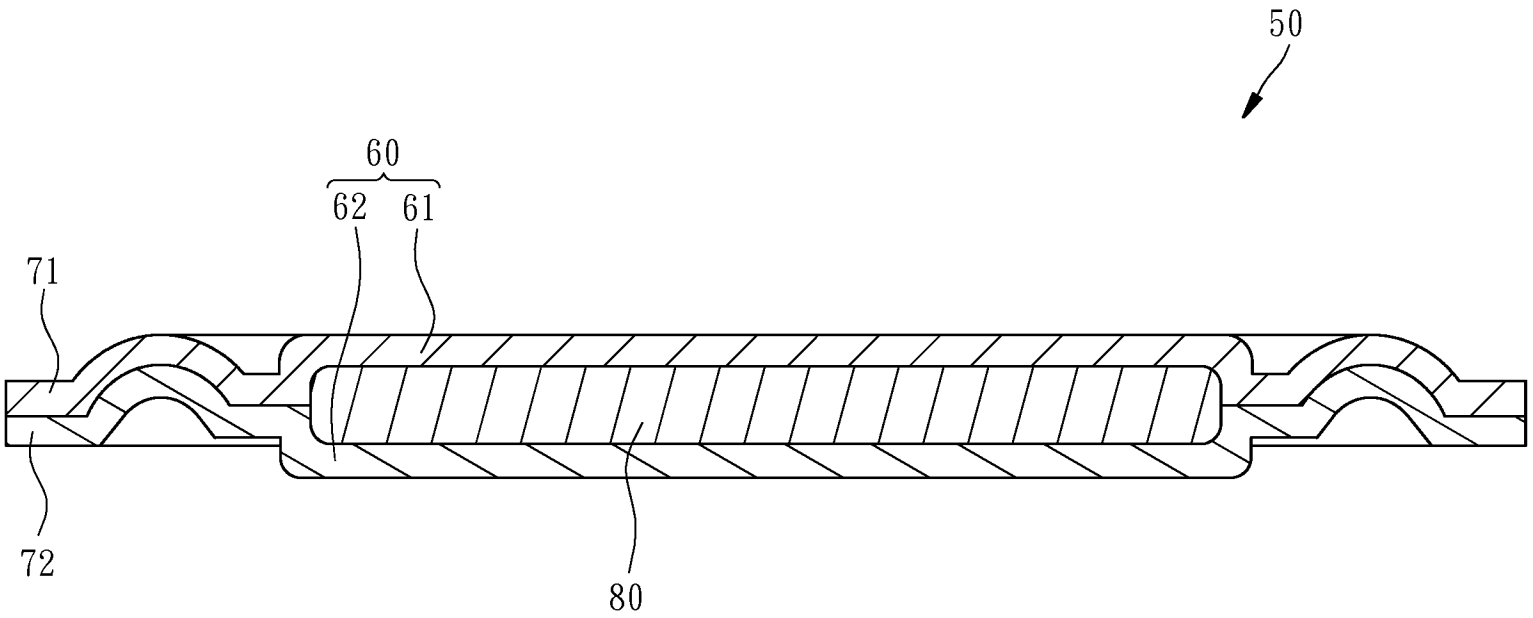
FIG. 3 is a sectional view of a passive radiator for earphone in accordance with a second embodiment of the present invention.

Referring to FIG. 3, an earphone 1 in accordance with a second embodiment is shown. According to this second embodiment, the vibrating diaphragm main body 60 of the passive radiator 50 comprises a first composite layer 61 and a second composite layer 62 stacked together, two surrounds 71 and 72 respectively surrounding and connected with the first composite layer 61 and the second composite layer 62, and a weight 80 embedded between the first composite layer 61 and the second composite layer 62. This second embodiment achieves the same effect of prohibiting the weight 80 from falling out of the vibrating diaphragm main body 60. Further, the weight 80 in this second embodiment can be a metal piece made by press forming; the first composite layer 61 and the second composite layer 62 can be prepared from different materials subject to actual requirements. Thus, this second embodiment widens the material selection range of the weight 80 and the vibrating diaphragm main body 60.

Further, injection molding technology can also be used for the fabrication of the passive radiator 50 in this second embodiment. During fabrication, put the weight 80 in the mold, and then mold the first composite layer 61 and the second composite layer 62 on the passive radiator 50, either in a proper order or at the same time, using injection molding technology. Thus, the weight 80 will not fall out of the vibrating diaphragm main body 60 easily. Whether using the technique of press forming or injection molding, these two methods can easily allocate the weight 80, and simplify mass fabrication of the passive radiator 50.

Figure 4:
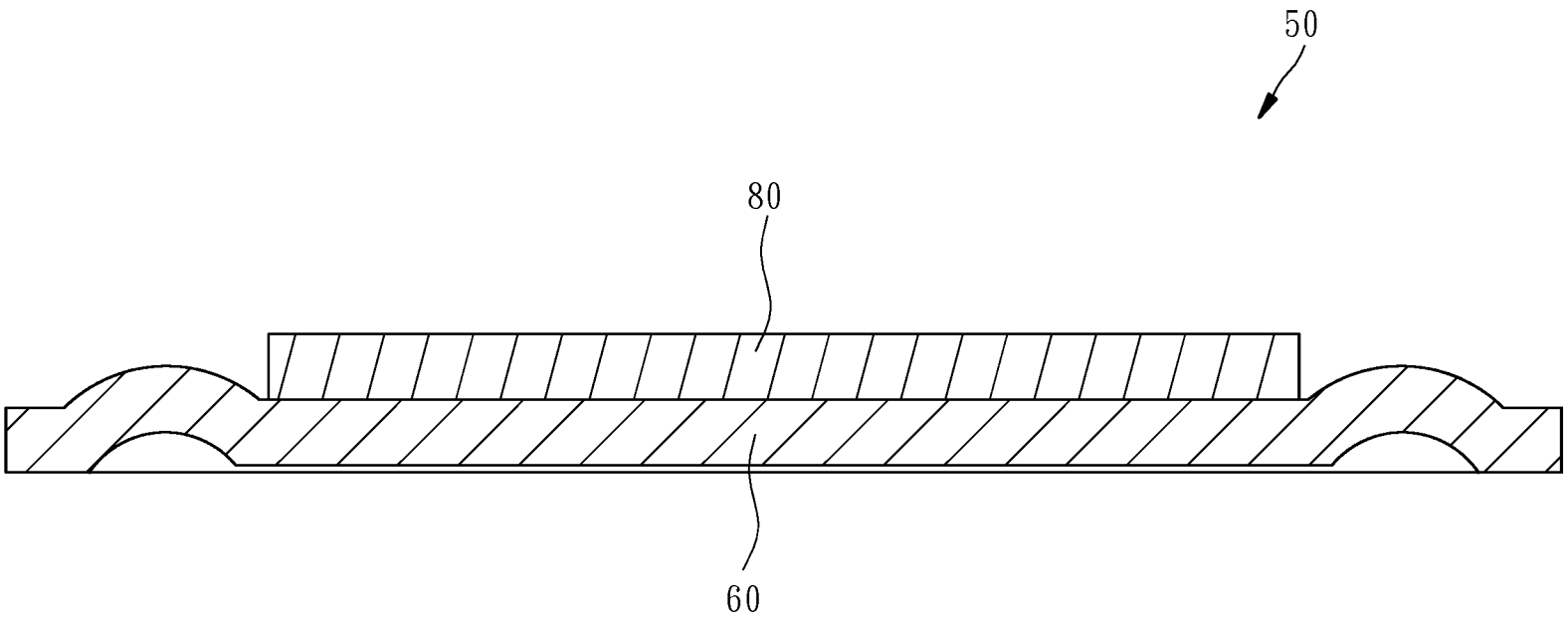
FIG. 4 is a sectional view of a passive radiator for earphone in accordance with a third embodiment of the present invention.

Referring to FIG. 4, an earphone in accordance with a third embodiment of the present invention is shown. This third embodiment is substantially similar to the aforesaid first embodiment with the exception that the weight 80 of the passive radiator 50 in this third embodiment is bonded to the top surface of the vibrating diaphragm main body 60. However, this top mounting technique is not a limitation. Any person skilled in the art can bond the weight 80 to the bottom surface of the vibrating diaphragm main body 60 subject to actual requirements, achieving the same effect of firmly securing the weight 80 in place.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An earphone, comprising:

a housing comprising a sound hole;

a speaker mounted in said housing; and a passive radiator disposed between said sound hole and said speaker, said passive radiator comprising a vibrating diaphragm main body and a weight embedded in said vibrating diaphragm main body;

wherein said housing further comprises an auxiliary sound hole disposed between said passive radiator and said speaker;

wherein said vibrating diaphragm main body comprises at least one through hole; said weight is embedded in said vibrating diaphragm main body by injecting a predetermined material through said at least one through hole into the inside of said vibrating diaphragm.

2. The earphone as claimed in claim 1, wherein said vibrating diaphragm main body comprises two composite layers stacked together; said weight is connected between said two composite layers.

3. The earphone as claimed in claim 2, wherein said two composite layers are prepared from different materials.

4. The earphone as claimed in claim 2, wherein said two composite layers are connected together using one of press forming and injection molding techniques.

5. The earphone as claimed in claim 1, wherein said weight is selected from the group of polyurethanes (PUs) and silicon compounds.

6. An earphone, comprising:

a housing comprising a sound hole;

a speaker mounted in said housing; and a passive radiator disposed between said sound hole and said speaker, said passive radiator comprising a vibrating diaphragm main body and a weight embedded in said vibrating diaphragm main body, wherein said vibrating diaphragm main body comprises at least one through hole; said weight is embedded in said vibrating diaphragm main body by injecting a predetermined material through said at least one through hole into the inside of said vibrating diaphragm.

7. The earphone as claimed in claim 6, wherein said weight is selected from the group of polyurethanes (PUs) and silicon compounds.

* * * * *